United States Patent [19]

Arsac

[11] 4,362,779

[45] Dec. 7, 1982

[54] PROCESS OF SILVERING ARTICLES HAVING A BASE OF POLYAMIDES

[75] Inventor: André Arsac, Vernaison, France

[73] Assignee: Rhone-Poulenc-Textile, France

[21] Appl. No.: 262,210

[22] Filed: May 8, 1981

Related U.S. Application Data

[63] Continuation of Ser. No. 876,664, Feb. 10, 1978, abandoned, which is a continuation of Ser. No. 686,401, May 14, 1976, abandoned, which is a continuation of Ser. No. 493,456, Jul. 31, 1974, abandoned.

[30] Foreign Application Priority Data

Aug. 1, 1973 [FR] France ..... 73 28614

[51] Int. Cl.[3] ..... B32B 7/00; B05D 3/10

[52] U.S. Cl. ..... 428/263; 427/304; 427/306; 427/307; 427/314; 427/393.1; 428/289; 428/458

[58] Field of Search ..... 427/304, 306, 390 B, 427/307, 314, 393.1; 428/263, 289, 458

[56] References Cited

U.S. PATENT DOCUMENTS

| | | | |
|---|---|---|---|
| 1,731,261 | 10/1929 | Pfiffer | 427/304 |
| 2,351,940 | 6/1944 | Dupuis | 427/304 |
| 2,986,480 | 5/1961 | Reiss | 427/304 |
| 3,686,017 | 8/1972 | Menikheim et al. | 427/304 |
| 3,686,019 | 8/1972 | Ohfuka | 427/304 |

FOREIGN PATENT DOCUMENTS 1283190 9/1969 Fed. Rep. of Germany .

OTHER PUBLICATIONS

Mason, L. F. A., *Photographic Processing Chemistry*, Focal, N.Y., 1966, pp. 16–21 and 28.

*Primary Examiner*—John D. Smith
*Assistant Examiner*—Janyce A. Bell
*Attorney, Agent, or Firm*—Stevens, Davis, Miller & Mosher

[57] ABSTRACT

Process of silvering articles such as textile articles in order to make them conductive and the articles silvered by this process.

The articles are subjected to the action of a reducing agent which swells the substrate and then to the action of an ammoniacal silver nitrate solution. When a polyamide is used as a substrate, a polyphenol is an acceptable reducing agent. Yarns and fibers treated by the process can be used for the manufacture of floor coverings, wall coverings, and articles of clothing as well as for the manufacture of heating articles.

8 Claims, No Drawings

PROCESS OF SILVERING ARTICLES HAVING A BASE OF POLYAMIDES

This is a continuation of application Ser. No. 876,664 filed Feb. 10, 1978, now abandoned, which in turn is a continuation of Ser. No. 686,401, filed May 14, 1976, now abandoned which in turn is a continuation of parent application Ser. No. 493,456 filed July 31, 1974, now abandoned.

BACKGROUND OF THE INVENTION

1. Field of the Invention

The present invention relates to a process for silvering articles, particularly textile articles, in order to make them conductors of electricity and improve their antistatic properties.

More particularly it applies to yarns intended for the manufacture of floor coverings such as carpets or rugs, wall coverings, and articles of clothing.

As a matter of fact, these articles, if they do not have good antistatic properties, will very rapidly become dirty due to the attraction of dust suspended in the air which has become electrically charged by friction. It is very difficult to keep these articles clean since the dirt, which remains on their surface, is difficult to eliminate. Another drawback resides in the fact that the user, upon coming into contact with a surface which is not antistatic, frequently receives discharges due to the accumulation of static electricity. Thus for reasons of safety, it is necessary to provide articles having antistatic properties. In addition to the above interest due to these properties, the articles obtained in accordance with the invention may also be used, due to their good conductivity, in the specialized field for the manufacture of heating articles such as floor covering, heat coiling, heating garments, etc.

2. Description of the Prior Art

One method of metallization which has been known for a long time consists of treating the articles with a solution of a metal salt and then reducing the metal salt to the metallic state by treatment with a reducing agent. However, the deposit of metal has the drawback that it adheres poorly to the treated article. Various solutions have been proposed in order to overcome this drawback. For example, as described in U.S. Pat. No. 3,058,845, it is possible to add swelling agents to the metallic salt treatment bath or else to carry out a preliminary treatment in accordance with French Patent Application No. 2,002,131 in order to sensitize the surface of the article to be treated. Another well known process as described in U.S. Pat. Nos. 2,303,871 and 2,355,933 and French Applications Nos. 2,002,131 and 2,108,024, consists in pretreating the article with a reducing agent and then treating it with a solution of the metal salt. However, in order for these treatments to give good results, it is necessary to add another reducing agent to the metal salt solution or to carry out a pretreatment to activate the surface to be treated.

All of these methods are complicated, since they involve either two treatment steps with baths containing different products, or at least three treatment steps with an additional activating step. Moreover, the adherence of the metal to the treated article is not always satisfactory.

SUMMARY OF THE INVENTION

A simple, economical and rapid method has now been found to obtain a strongly adhering deposit of metal on the treated article.

The invention relates to a process for silvering articles having a polyamide base which comprises subjecting the article to the action of a reducing agent which also serves to swell the polyamide and then to the action of an ammoniacal silver nitrate solution.

The articles upon which the process can be carried out may be in various forms, such as fibers, continuous threads, threads, spun yarns, flock, films, fabrics, knitted goods or non-woven goods. They may consist in whole or in part of any known polyamide which can be shaped or formed into a thread or film, such as the compounds obtained from an amino acid or a lactam, or one of their derivatives, or substantially equimolar quantities of at least one diamine and at least one diacid or one of their derivatives, whether these compounds be aliphatic or aromatic. Copolymers or mixtures of these polymers with each other or with other polymers can also be used.

DESCRIPTION OF THE PREFERRED EMBODIMENTS

In accordance with the invention, the article is first subjected to the action of a reducing agent which is a swelling agent for the polyamide. It has been found that polyphenol reducing agents, such as orthophenol, 1,4-diphenol, 1,3,5 trihydroxy benzene, satisfy these conditions and are particularly well suited for carrying out the process.

The article is treated in the following fashion. The article is subjected to the action of polyphenol by conventional impregnation, for instance by immersion into an aqueous solution containing from about 1 to 30% by weight polyphenol. Above this range, the action of the polyphenol is too strong and can result in the degradation of the polyamide. The impregnation is carried out at a temperature between room temperature and 90° C., and preferably between 40° and 80° C. The excess polyphenol is then eliminated by rapid rinsing with distilled water at 60° C. or by a conventional mechanical drying.

In accordance with the invention, the article is then treated with an ammoniacal silver nitrate solution containing from about 1 to 10% by weight silver nitrate, and preferably 2 to 3% silver nitrate. This solution is conventionally prepared by adding an ammoniacal solution to the solution of silver nitrate in such a manner that the final solution contains between 3 and 4 mols of ammonia (preferably 3.5 mols) per mol of silver nitrate. The article is immersed into this solution which has been heated to a temperature which is between about 50° and 90° C. for a variable period of time which may be very short such as only about a few seconds. The article is then rinsed with running water and with agitation and dried in the customary fashion.

The process of the present invention has the following advantages: it is very simple to carry out, since it comprises only two treatment steps; it is fast, since the reaction times of the products are short; it is economical, since the solutions used are of low concentration (the solution of polyphenol may even be used several times after regeneration); and finally, the deposited silver adheres strongly to the article treated.

The following examples are given by way of illustration and not of limitation in order to illustrate the invention.

EXAMPLE 1

Polyhexamethylene adipamide fibers of 22 dtex (20 den.) and 70 mm long are immersed in an aqueous solution containing 20% by weight orthodiphenol at 60° C. for one minute. The bath ratio is 1:20. Thereupon the fibers are rinsed with distilled water of 60° C. for ten seconds and mechanically dried for one minute.

The fibers are immersed in an ammoniacal solution of silver nitrate at a concentration of 2.5% by weight for one minute at 60° C.; the bath ratio is 1:20. They are washed with running water of room temperature for two or three minutes and then dried in a ventilated stove at 80° C. for one hour.

The antistatic properties are verified by means of a ROTHSCHILD type R 1020 electrometer which measures the half-discharge time of a sample consisting of 1.5 g of fibers which has been previously charged to 100 volts in the following manner. The electrode intended to measure the resistance is attached to the electrometer. The sample is stretched between two clamps and charged to 100 volts and the time for the sample to be discharged to 50 volts is measured in seconds.

The tests carried out on the sample of fibers treated in the manner set forth above by the present process and on a control sample of identical but untreated fibers gave the following results:

Half-discharge time:

treated sample: 0 second control sample: 645 seconds

The fibers silvered in accordance with the process of the present application truly have good antistatic properties.

EXAMPLE 2

A continuous polyhexamethylene adipamide yarn of 17 dtex (15 den.), single strand, of trilobate cross section, is immersed in an aqueous solution containing 20% by weight orthodiphenol at 60° C. for 10 minutes. The bath ratio is 1:20. The yarn is rinsed and mechanically dried as in Example 1 and then immersed into a 2.5% ammoniacal silver nitrate solution for one minute at 60° C. The bath ratio is 1:20. It is washed and dried as in Example 1.

The charge of static electricity assumed by the yarn is measured with the ROTHSCHILD electrometer by the following method:

Principle of the Measurement:

The yarn is charged with static electricity by dynamic rubbing on a stationary body. It is then wound on an insulated metal pulley connected by a brush to an electrometer which indicates in volts the difference in potential due to the electrification.

Procedure:

The yarn to be tested is brought to a feeder and passes into a grip tensioner where it is charged with static electricity. It is then wound on an aluminum pulley insulated from the frame by a core of Bakelite placed between the body of the pulley and its shaft. A graphite brush picks up the electricity from the flanges of the pulley and conducts it to the electrometer. The electrometer is charged periodically every eight seconds before it is grounded. This charge time is sufficient for the indicating needle to become stable and permit reading.

Operating conditions:

The yarn is fed at a speed of 300 meters/minute. The tension imparted by the passing over the bars is 10 grams. The operation is carried out in an atmosphere having a temperature between 21° and 24° C. with a humidity varying from 45 to 55%.

Results:

The results of the examination on the treated yarn, read from the electrometer, after periodic indication of the same value on the dial (one to two minutes), compared with the results given by the examination of an identical but unsilvered yarn are as follows:

Charge:

treated yarn: 0 volt untreated yarn: 2,000 volts

As the treated yarn has not become charged, it has good antistatic properties.

EXAMPLE 3

A continuous polycaprolacton yarn of 26 dtex 20 den., 16 strands, is treated in the same manner as in Example 1, except that the aqueous solution of orthodiphenol contains 10% by weight orthodiphenol. The half-discharge time of the yarn is measured in the same manner as previously. These results are as follows:

Half-discharge time:

treated yarn: 0 second untreated yarn: 480 seconds

EXAMPLE 4

Polyhexamethylene adipamide fibers of 22 dtex 20 den. are treated with a saturated aqueous solution of 1,3,5 trihydroxybenzene at room temperature for two hours with the bath ratio being 1:20. The fibers are washed with distilled water at 60° C. and are mechanically dried followed by immersion in a 10% ammoniacal silver nitrate solution for two hours at room temperature. They are washed and dried and the fibers examined as in Example 1 with the following results:

Half-discharge time:

treated fibers: 1 second untreated fibers: 645 seconds

EXAMPLE 5

Polyhexamethylene adipamide fibers of 22 dtex 20 den. are treated for one minute with an aqueous solution containing 20% by weight of 1,4 diphenol at 60° C. The fibers are then mechanically dried for a minute and immersed in a 10% by weight ammoniacal silver nitrate solution for one minute at 60° C. They are rinsed and dried and the fibers examined as in Example 1 with the following results:

Half-discharge time:

treated fibers: 0 second untreated fibers: 645 seconds.

What is claimed is:

1. A process for improving the antistatic properties of an article made of a polyamide polymer by covering at least one surface of said polyamide article with a layer of silver consisting essentially of treating at least one surface of said article with an aqueous bath of a polyhydroxy benzene reducing agent which is a swelling agent for said polyamide, with a concentration of about 1% to about 30% by weight at a temperature between room temperature and 90° C. to permit said polyhydroxy benzene reducing agent to swell said polyamide, and then treating the resulting product with an ammoniacal silver nitrate solution.

2. The process of claim 1 wherein treatment with said reducing agent is carried out at a temperature between 40° C. and 80° C.

3. A process of silvering according to claim 1, wherein said polyhydroxy benzene is orthodiphenol.

4. A process of silvering according to claim 1, wherein said polyhydroxy benzene is 1,4-diphenol.

5. A process of silvering according to claim 1, wherein said polyhydroxy benzene is 1,3,5-trihydroxybenzene.

6. The process of claim 1 wherein the articles made of a polyamide polymer are textile articles.

7. Textile articles antistatically treated by the process of claim 1.

8. The process of claim 6 wherein said polyhydroxybenzene reducing agent is present at a concentration of about 10% to about 30% by weight.

* * * * *